US008514032B1

(12) United States Patent
Buckley et al.

(10) Patent No.: US 8,514,032 B1
(45) Date of Patent: Aug. 20, 2013

(54) BROAD BAND COMPACT LOAD FOR USE IN MULTIFUNCTION PHASED ARRAY TESTING

(75) Inventors: Michael J. Buckley, Marion, IA (US); Jeremiah D. Wolf, Marion, IA (US); Brian J. Herting, Marion, IA (US); John C. Mather, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 331 days.

(21) Appl. No.: 12/836,327

(22) Filed: Jul. 14, 2010

(51) Int. Cl.
*H01P 1/26* (2006.01)

(52) U.S. Cl.
USPC ..... 333/22 R

(58) Field of Classification Search
USPC ..... 333/22 R
See application file for complete search history.

(56) References Cited

U.S. PATENT DOCUMENTS 3,678,417 A * 7/1972 Ragan et al. ..... 333/22 R
2006/0040459 A1 * 2/2006 Phan et al. ..... 438/382

* cited by examiner

*Primary Examiner* — Stephen Jones
(74) *Attorney, Agent, or Firm* — Donna P. Suchy; Daniel M. Barbieri

(57) ABSTRACT

The present invention is directed to a matched load. The matched load may include a stripline section and multiple resist material sections. The multiple resist material sections may be connected to the stripline section and may each include a resist material. The resist material may be a metal alloy film. Further, the load may be configured for operating over a frequency band ranging from 9 GHz to 18 GHz. Still further, the load may be configured for providing a return loss of less than −25 dB at each operating frequency included in the 9 GHz to 18 GHz frequency band. Still further, the load is compact, such that multiple loads may fit into a dual polarized radiating element cell.

20 Claims, 5 Drawing Sheets

BROAD BAND COMPACT LOAD FOR USE IN MULTIFUNCTION PHASED ARRAY TESTING

FIELD OF THE INVENTION

The present invention relates to the field of antennas (ex.—multifunction antennas) and more particularly to a broad band compact load for use in multifunction phased array testing.

BACKGROUND OF THE INVENTION

Multifunction phased array antennas may require radiating element testing in a fractional array (ex.—a small array with approximately five hundred individual radiating elements that approximates the performance of radiating elements in the interior of a large finite array and enables the performance of edge and corner elements to be measured). At $K_u$ band (which may be used in a number of Unmanned Aerial Vehicle (UAV) systems), each radiating element may require an interconnect and a matched load. For example, the interconnects implemented may be Gore™ 100 interconnects or Corning Gilbert GPPO® interconnects, which may cost $25.00 each, while the matched loads implemented may cost $15.00 each. Thus, if the fractional array includes five hundred radiating elements (as mentioned above), the cost spent on interconnects and matched loads may total as much as $20,000.00. Such expense becomes even more of a factor when multiple fractional arrays need to be built in order to generate a satisfactory antenna system design. An alternative to building the fractional array is to assemble the entire antenna system (ex.—which includes the radiating element(s) and manifold) and then test the entire antenna system. However, if building of a fractional array is bypassed and a problem is found with the antenna system during testing, the end result may be a negative impact on scheduling (ex.—production delays) along with having to go ahead and incur the subsequent cost of building a fractional array and separate manifold anyway.

Thus, it would be desirable to have a high performance and low cost load structure (ex.—a matched load) which addresses the problems associated with currently available solutions.

SUMMARY OF THE INVENTION

Accordingly an embodiment of the present invention is directed to a matched load, including: a stripline section; and at least one resist material section, the at least one resist material section being connected to the stripline section, the at least one resist material section including a resist material.

A further embodiment of the present invention is directed to a matched load, including: a stripline section; and a plurality of resist material sections, the plurality of resist material sections being connected to the stripline section, the plurality of resist material sections each including a resist material, wherein the resist material is a metal alloy film.

A still further embodiment of the present invention is directed to a matched load, including: a stripline section; and a plurality of resist material sections, the plurality of resist material sections being connected to the stripline section, the plurality of resist material sections each including a resist material, the resist material being a metal alloy film, wherein the load is configured for operating over a frequency band ranging from 9 GHz to 18 GHz and is further configured for providing a return loss of less than −25 decibels at each operating frequency included in the frequency band ranging from 9 GHz to 18 GHz.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
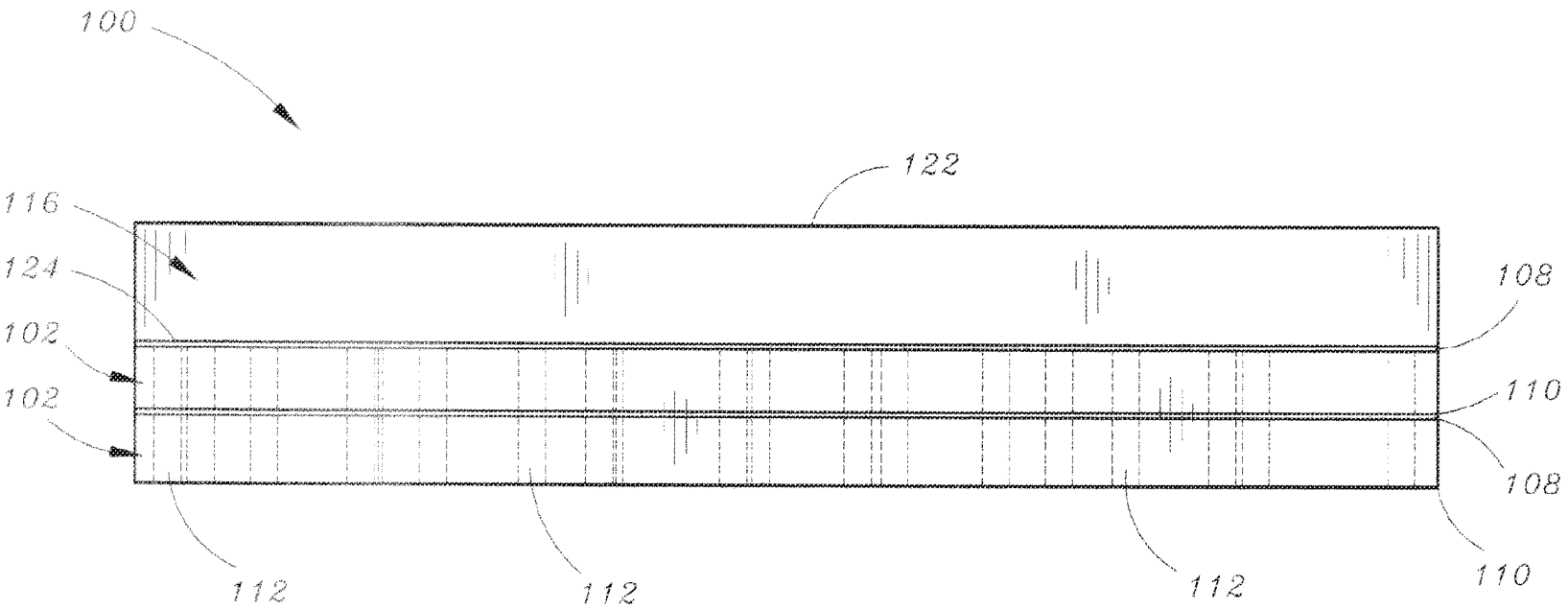
FIG. 1 is cross-sectional view of a unit cell assembly in accordance with an exemplary embodiment of the present invention.
Figure 4:
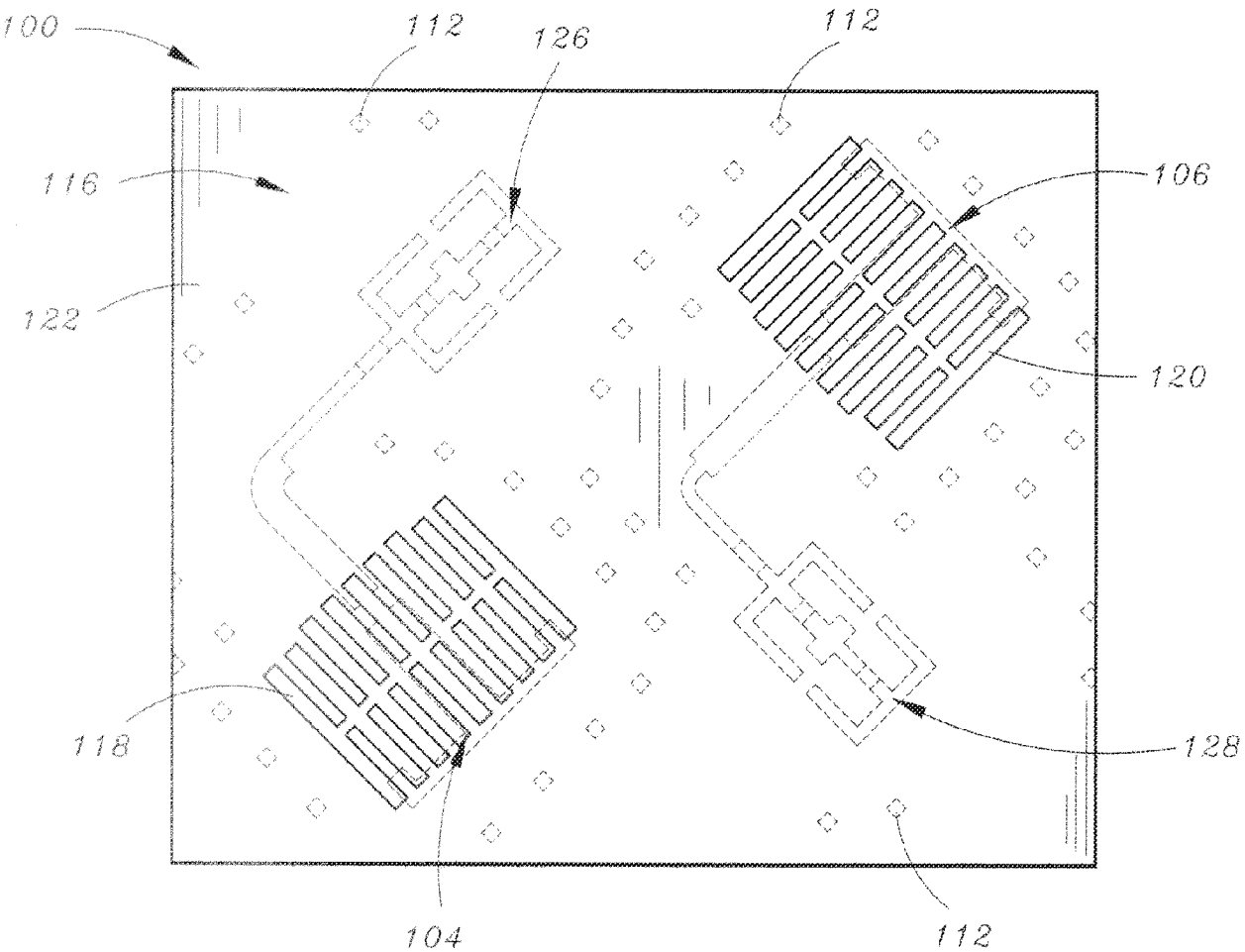
FIG. 4 is a top plan view of unit cell assembly shown in FIG. 1, in accordance with an exemplary embodiment of the present invention.

Referring to FIGS. 1 and 4, a unit cell assembly in accordance with an exemplary embodiment of the present invention is shown. In a current exemplary embodiment of the present invention, the unit cell assembly 100 may include one or more (ex.—two) stripline feed layers 102. In at least one exemplary embodiment of the present invention, the stripline feed layers 102 may be connected to each other (ex.—stacked upon each other) as shown in FIG. 1. In further embodiments of the present invention, each stripline feed layer 102 may be at least partially constructed of printed circuit board material (s), dielectric material(s), laminate material(s) and/or bonding material(s) (ex.—Arlon CLTE™ core(s)). In still further embodiments of the present invention, each stripline feed layer 102 may be configured to have a thickness of 20 mil (ex.—$^{20}/_{1000}$ inches thick).

Figure 2:
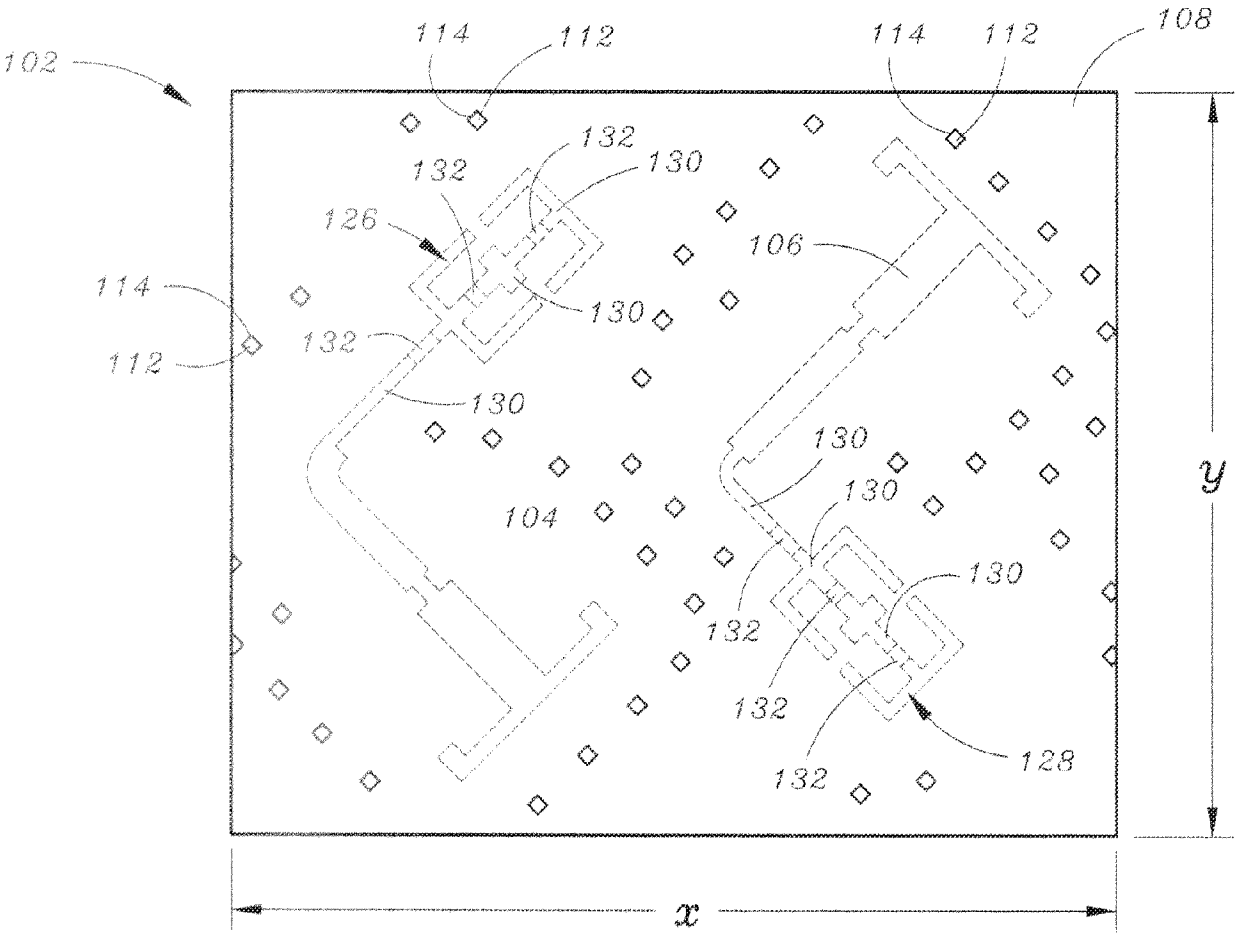
FIG. 2 is a top plan view of a stripline feed layer of the unit cell assembly shown in FIG. 1, in accordance with an exemplary embodiment of the present invention.

In exemplary embodiments of the present invention, the stripline feed layers 102 may be connected to each other via an adhesive material (ex.—Speedboard C® adhesive). In further embodiments of the present invention, each stripline feed layer 102 may include a first stripline feed 104 (ex.—a first radiating element 104) and a second stripline feed 106 (ex.—a second radiating element 106) (as shown in FIG. 2). In current exemplary embodiments of the present invention, the first stripline feed 104 may be configured for providing horizontal polarization for the unit cell assembly 100 (ex.—may be a horizontal polarization feed 104). In further embodiments of the present invention, the second stripline feed 106 may be configured for providing vertical polarization for the unit cell assembly 100 (ex.—may be a vertical polarization feed 106). In still further embodiments of the present invention, each stripline feed layer 102 may be configured as a rectangular grid having a top surface 108 and a bottom surface 110 (as shown in FIG. 1), further having a thickness (ex.—distance from top surface 108 to bottom surface 110) of 20 mil, and further having x and y axis dimensions (ex.—a footprint) of 0.60 free space wavelengths×0.48 free space wavelengths at an operating frequency of 14.5 Gigahertz (GHz).

In further embodiments of the present invention, each of the stripline feeds (108, 110) of the stripline feed layers 102 may be configured for being connected to a vertical transition to feed a stripline manifold. In still further embodiments of the present invention, each of the stripline feed layers 102 may be further configured with a plurality of channels or vias 112 which may be formed through the stripline feed layers 102 so as to vertically extend through the stripline feed layers 102 (ex.—through the top and bottom surfaces 108 and 110 of the stripline feed layers 102). In further embodiments of the present invention, the vertical vias 112 may be configured for eliminating resonances in the stripline feed layers 102. In additional exemplary embodiments of the present invention, a plurality of via fences 114 may be configured for being at least partially located within the vias 112.

Figure 3:
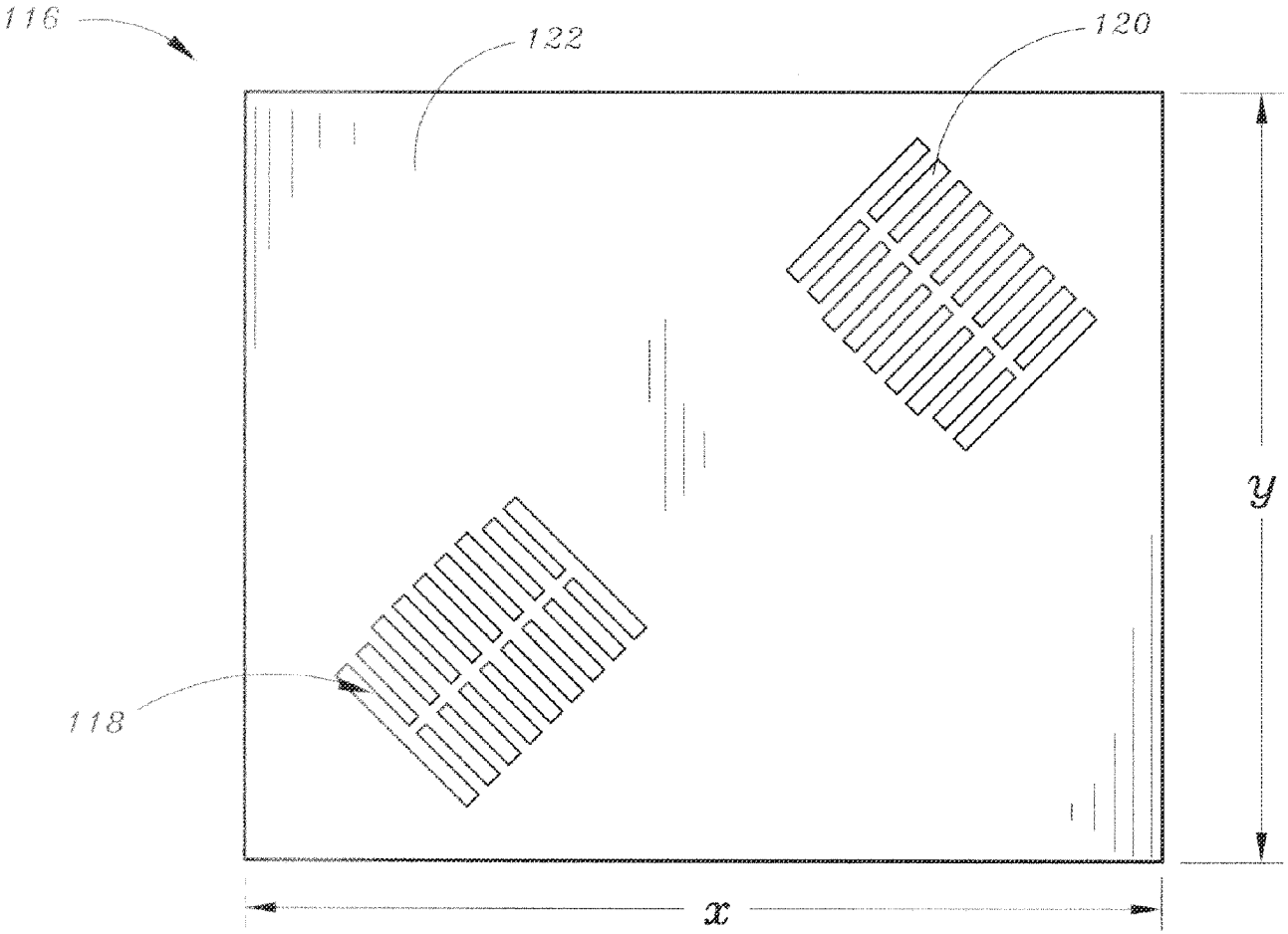
FIG. 3 is a top plan view of a dielectric superstrate layer of the unit cell assembly shown in FIG. 1, in accordance with an exemplary embodiment of the present invention.

In current exemplary embodiments of the present invention, the unit cell assembly 100 may further include a dielectric superstrate layer 116 (ex.—a ground plane 116). In further embodiments of the present invention, the dielectric superstrate layer 116 may be connected to the stripline feed layers 102. For example, the dielectric superstrate layer 116 may be positioned (ex.—stacked) upon the stripline feed layers 102 as shown in FIG. 1. In exemplary embodiments of the present invention, the dielectric superstrate layer 116 may be configured with a plurality of slots. For instance, the dielectric superstrate layer 116 may include a first slot 118 and a second slot 120 (as shown in FIG. 3). In further embodiments of the present invention, the first slot 118 may be a horizontal polarization slot and the second slot 120 may be a vertical polarization slot. In still further embodiments of the present invention, when the dielectric superstrate layer 116 is connected to the stripline feed layers 102, the vertical polarization slot 120 may be positioned or located so as to be aligned with the vertical polarization feed 106 (as shown in FIG. 4), thereby allowing the vertical polarization feed 106 to provide electromagnetic energy (which may be radiated in a vertically-polarized radiation pattern) via the vertical polarization slot 120. In further embodiments, when the dielectric superstrate layer 116 is connected to the stripline feed layers 102, the horizontal polarization slot 118 may be positioned or located so as to be aligned with the horizontal polarization feed 104 (as shown in FIG. 4), thereby allowing the horizontal polarization feed 108 to provide electromagnetic energy which may be radiated in a horizontally-polarized radiation pattern via the horizontal polarization slot 118. Thus, the unit cell assembly 100 of the present invention may be a dual-polarized unit cell assembly 100 (ex.—may include or provide dual-polarized radiating elements)

In exemplary embodiments of the present invention, the dielectric superstrate layer 116 may be configured as a rectangular grid having a top surface 122 and a bottom surface 124 (as shown in FIG. 1). When the dielectric superstrate layer 116 is connected to the stripline feed layers 102, the top surface 122 of the dielectric superstrate layer 116 may be oriented away from the stripline feed layers 102, while the bottom surface 124 may be oriented towards the stripline feed layers 102. In further embodiments of the present invention, the dielectric superstrate layer 116 may be configured to have a thickness (ex.—distance from top surface 122 to bottom surface 124) of 30 mil. In still further embodiments of the present invention, the dielectric superstrate layer 116 may have x and y axis dimensions (ex.—a footprint) of 0.60 free space wavelengths×0.48 free space wavelengths at an operating frequency of 14.5 Gigahertz (GHz) (as shown in FIG. 3). In further embodiments of the present invention, the dielectric superstrate layer 116 may be at least partially constructed of printed circuit board material(s), dielectric material(s), laminate material(s), and/or bonding material(s) (ex.—Arlon CLTE™ core). In still further embodiments of the present invention, the top surface 108 of each stripline feed layer 102 may be oriented towards the dielectric superstrate layer 116, while the bottom surface 110 of each stripline feed layer 102 may be oriented away from the dielectric superstrate layer 116.

In current exemplary embodiments of the present invention, each stripline feed layer 102 of the unit cell assembly 100 may include a first load 126 and a second load 128, said loads (126, 128) being embedded in said stripline feed layer (s) 102. In further embodiments of the present invention, the first load 126 may be connected to the first stripline feed 104. In still further embodiments of the present invention, the second load 128 may be connected to the second stripline feed 106. In further embodiments of the present invention, each load (126, 128) may be a matched load (ex.—a load having an impedance value which results in maximum absorption of energy from a signal source). In still further embodiments of the present invention, the matched loads (126, 128) may be wideband matched loads configured for operation over a wide frequency band (ex.—9 to 18 Gigahertz (GHz)).

Figure 5:
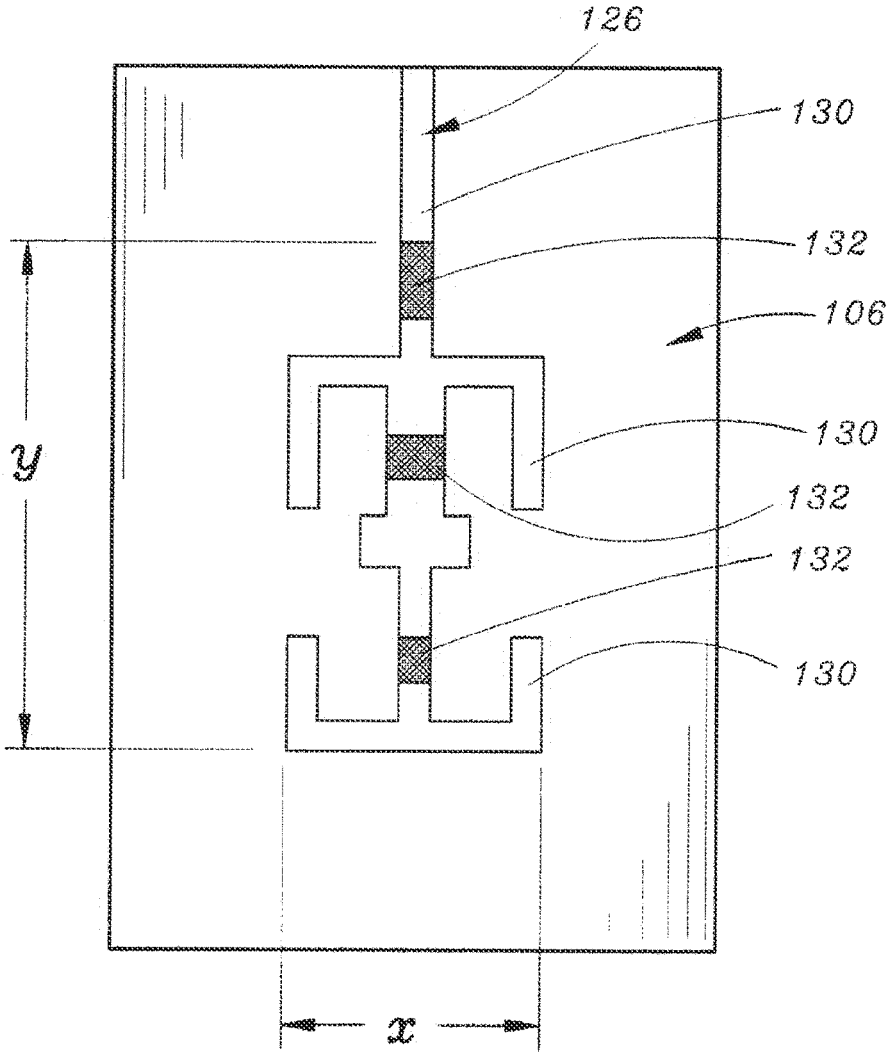
FIG. 5 is a close-up view of a matched load of the unit cell assembly shown in FIG. 1, in accordance with an exemplary embodiment of the present invention.

In exemplary embodiments of the present invention, each matched load (126, 128) may include (ex.—may be at least partially formed of) stripline 130. (as shown in FIG. 5). For example, the stripline 130 may be at least partially formed of copper. In further embodiments of the present invention, each matched load (126, 128) may include one or more sections of resist material 132 (ex.—each matched load (126, 128) may be a multi-section matched load). For instance, the one or more sections of resist material 132 may be connected to the stripline 130 (ex.—connected to the copper of the stripline 130) and may further be embedded in said stripline feed layer(s) 102, said stripline feed layer(s) 102 being formed of printed circuit board material(s), dielectric material(s), laminate material(s) (ex.—Rogers RT/Duroid® 6002) and/or bonding material(s) (ex.—Speedboard C® adhesive).

In current exemplary embodiments of the present invention, the resist material 132 may be a metal alloy film (ex.—a thin (ex.—0.1-0.4 microns thick) film Nickel alloy, such as a Nickel Chromium alloy, Nickel Chromium Aluminum Silicon, or Chromium Silicon Monoxide), and may be configured for being electrodeposited (ex—electroplated) onto copper and/or may be further configured for being laminated onto a dielectric material. For instance, the resist material may be Ohmega-Ply® resistive material (ex.—25 ohms/square Ohmega-Ply® resistive material), Ticer (TCR®) resistive material, or the like.

In exemplary embodiments of the present invention, the stripline 130 of the matched load (126 or 128) may have a width of 10 mils ($^{10}/_{1000}$ of an inch). In further embodiments of the present invention, the stripline 130 of the matched load (126 or 128) may be an eighty ohm stripline (ex.—may have an eighty ohm impedance), such that it may be configured for implementation in $K_u$ band systems ($K_u$ band systems may require an 80 ohm stripline due to packaging constraints). In alternative embodiments of the present invention, the stripline 130 of the matched load (126 or 128) may be a fifty ohm stripline (ex.—may have a fifty ohm impedance).

In current exemplary embodiments of the present invention, each matched load (126, 128) may have an electrical width of 0.17 wavelengths at 18 GHz. In further embodiments of the present invention, each matched load (126, 128) may have an electrical length of 0.30 wavelengths at 18 GHz. In still further embodiments of the present invention, each matched load (126, 128) may have a wavelength of 382 mils at 18 GHz (ex.—when implemented in Rogers RT/Duroid® 6002). In further embodiments of the present invention, each matched load (126, 128) may have small x and y axis dimensions (ex.—a small footprint), such as 131 mils by 62 mils (131 mils×62 mils), as shown in FIG. 5. Since each matched load (126, 128) has such a small footprint (ex.—is compact), they are configured to fit into the unit cell assembly 100. In still further embodiments of the present invention, each matched load (126, 128) is configured for providing a return loss of approximately −25 decibels (dB) or lower (ex.—less than −20 db) over the entire operating frequency band of the unit cell assembly 100. In further embodiments of the present invention, the matched load(s) (126, 128) promote reduced cost for broadband multifunction array development in that standard PCB manufacturing techniques may be implemented for integrating the matched load(s) (126, 128) into the unit cell assembly 100.

In exemplary embodiments of the present invention, the unit cell assembly 100 in which the matched load(s) (126, 128) are implemented may be a unit cell assembly 100 for a Military Satellite (MilSat) antenna array (ex.—a dual-polarized DataPath Satellite Communications (DataPath SATCOM) antenna array). In further embodiments of the present invention, the matched load(s) (126, 128) may be implemented in unit cell assemblies for multifunction wide band phased array antennas.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A matched load, comprising:

at least three stripline sections, including at least a first stripline section, a second stripline section, and a third stripline section; and a plurality of resist material sections, at least one of the plurality of resist material sections being connected to the first stripline section and the second stripline section, at least one other resist material section of the plurality of resist material sections being connected to the second stripline section and the third stripline section, each of the plurality of resist material sections including a resist material, wherein the resist material is a metal alloy film, wherein the load is connected to a radiating element, wherein the load is implemented in or on a stripline feed layer of a unit cell assembly, and wherein the unit cell assembly is a satellite antenna array unit cell assembly.

2. The matched load as claimed in claim 1, wherein the first stripline section is at least partially formed of copper.

3. The matched load as claimed in claim 1, wherein the resist material is Chromium Silicon Oxide.

4. The matched load as claimed in claim 1, wherein the resist material is approximately twenty-five ohms/square resistive material.

5. The matched load as claimed in claim 1, wherein the first stripline section has a width of 10 mils.

6. The matched load as claimed in claim 1, wherein the first stripline section has an impedance value included in a range of impedance values ranging from fifty ohms to eighty ohms.

7. The matched load as claimed in claim 1, wherein the load is configured for operating over a frequency band ranging from 9 GHz (gigahertz) to 18 GHz.

8. The matched load as claimed in claim 1, wherein the load has an electrical width of 0.17 wavelengths and an electrical length of 0.30 wavelengths when the load is operating at a frequency of 18 GHz (gigahertz).

9. The matched load as claimed in claim 1, wherein the load has a footprint measuring 131 mils×62 mils.

10. The matched load as claimed in claim 1, wherein the stripline feed layer is at least partially formed of at least one of: printed circuit board material, dielectric material, laminate material, and bonding material.

11. The matched load as claimed in claim 1, wherein the resist material has a thickness value included in a range of thickness values ranging from 0.1 microns to 0.4 microns.

12. The matched load as claimed in claim 11, wherein the resist material is a Nickel Chromium alloy.

13. The matched load as claimed in claim 12, wherein the resist material is Nickel Chromium Aluminum Silicon.

14. A matched load, comprising:

a plurality of stripline sections, including at least a first stripline section and a second stripline section; and a plurality of resist material sections, at least one of the plurality of resist material sections being connected to the first stripline section and the second stripline section, each of the plurality of resist material sections each including a resist material, the resist material being a metal alloy film, wherein the load is connected to a radiating element, wherein the load is implemented in or on a stripline feed layer of a unit cell assembly, wherein the unit cell assembly is a satellite antenna array unit cell assembly, and wherein the load is configured for operating over a frequency band ranging from 9 GHz (gigahertz) to 18 GHz and is further configured for providing a return loss of less than −25 decibels at each operating frequency included in the frequency band ranging from 9 GHz to 18 GHz.

15. The matched load as claimed in claim 14, wherein the resist material is Chromium Silicon Oxide.

16. The matched load as claimed in claim 14, wherein the resist material is approximately twenty-five ohms/square resistive material.

17. The matched load as claimed in claim 14, wherein the first stripline section has an impedance value included in a range of impedance values ranging from fifty ohms to eighty ohms.

18. The matched load as claimed in claim 14, wherein the load has an electrical width of 0.17 wavelengths and an electrical length of 0.30 wavelengths when the load is operating at a frequency of 18 GHz (gigahertz).

19. The matched load as claimed in claim 14, wherein the resist material has a thickness value included in a range of thickness values ranging from 0.1 microns to 0.4 microns.

20. The matched load as claimed in claim 19, wherein the resist material is Nickel Chromium Aluminum Silicon.

* * * * *